US009293858B2

(12) United States Patent
Iikhanov et al.

(10) Patent No.: US 9,293,858 B2
(45) Date of Patent: Mar. 22, 2016

(54) SCREW DOWN CONNECTOR

(71) Applicant: Bren-Tronics, Inc., Commack, NY (US)

(72) Inventors: Azer Iikhanov, Brooklyn, NY (US); Peter J. Burke, East Northport, NY (US); Sai Fung, Melville, NY (US); Leo A. Brenna, Northport, NY (US)

(73) Assignee: Bren-Tronics, Inc., Commack, NY (US)

( * ) Notice: Subject to any disclaimer, the term of this patent is extended or adjusted under 35 U.S.C. 154(b) by 9 days.

(21) Appl. No.: 14/287,114

(22) Filed: May 26, 2014

(65) Prior Publication Data

US 2015/0340806 A1 Nov. 26, 2015

(51) Int. Cl.

| | |
|---|---|
| ***H01R 13/52*** | (2006.01) |
| ***H01R 13/621*** | (2006.01) |
| ***H01R 13/58*** | (2006.01) |

(52) U.S. Cl.

CPC ..... *H01R 13/6215* (2013.01); *H01R 13/5219* (2013.01); *H01R 13/5845* (2013.01)

(58) Field of Classification Search

CPC ..... H01R 13/5219; H01R 13/5221; H01R 13/523; H01R 13/22; H01J 29/925

USPC ..... 439/278, 279, 362, 627, 271

See application file for complete search history.

(56) References Cited

U.S. PATENT DOCUMENTS

| | | | | | |
|---|---|---|---|---|---|
| 2,890,433 | A | * | 6/1959 | Liljenberg | 439/278 |
| 3,221,794 | A | * | 12/1965 | Acres | 411/353 |
| 3,428,780 | A | * | 2/1969 | Decrouez | 219/256 |
| 3,555,491 | A | * | 1/1971 | Moss | 439/363 |
| 3,599,172 | A | * | 8/1971 | Tuchto | 439/405 |
| 3,760,335 | A | * | 9/1973 | Roberts | 439/398 |
| 3,866,996 | A | * | 2/1975 | Elkins | 439/404 |
| 3,920,306 | A | * | 11/1975 | Barnett et al. | 439/459 |
| 3,975,075 | A | * | 8/1976 | Mason | 439/107 |
| 4,035,051 | A | * | 7/1977 | Guy | 439/464 |
| 4,037,902 | A | * | 7/1977 | Miller | 439/294 |
| 4,127,315 | A | * | 11/1978 | McKee | 439/468 |
| 4,258,969 | A | * | 3/1981 | Stallard | 439/53 |
| 4,382,650 | A | * | 5/1983 | Herrmann, Jr. | 439/278 |
| 4,421,376 | A | * | 12/1983 | Cosmos et al. | 439/461 |
| 4,432,592 | A | * | 2/1984 | Boutros et al. | 439/460 |
| 4,456,319 | A | * | 6/1984 | Poulain Ricros | 439/359 |
| 4,483,580 | A | * | 11/1984 | Pelczarski | 439/460 |
| 4,558,916 | A | * | 12/1985 | Hehl | 439/467 |
| 4,580,865 | A | * | 4/1986 | Fryberger | 439/277 |
| 4,697,864 | A | * | 10/1987 | Hayes et al. | 439/444 |
| 4,705,339 | A | * | 11/1987 | Hayes et al. | 439/277 |
| 4,767,350 | A | * | 8/1988 | Cooper et al. | 439/271 |
| 4,786,260 | A | * | 11/1988 | Spaulding | 439/607.01 |
| 4,921,437 | A | * | 5/1990 | Cooper et al. | 439/275 |
| 4,944,688 | A | * | 7/1990 | Lundergan | 439/275 |
| 5,199,903 | A | * | 4/1993 | Asick et al. | 439/607.47 |
| 5,318,463 | A | * | 6/1994 | Broschard et al. | 439/541.5 |
| 5,340,329 | A | * | 8/1994 | Hirai | 439/357 |
| D354,941 | S | * | 1/1995 | Lentz et al. | D13/138.1 |

(Continued)

*Primary Examiner* — Abdullah Riyami
*Assistant Examiner* — Vladimir Imas
(74) *Attorney, Agent, or Firm* — Keusey & Associates, P.C.

(57) ABSTRACT

A plug having a screw-down feature to securely connect to a socket of fixed, existing design. The plug includes flanges with screw receiving bores. Plug screws inserted through the bores deliver a coupling force for a variable compression seal that makes the connection waterproof. The screw-down connection includes upgrading the existing socket machine screws to a socket retaining member. The screw-down feature prevents the plug from accidentally disconnecting from the socket.

18 Claims, 3 Drawing Sheets

(56) References Cited

U.S. PATENT DOCUMENTS

| | | | | | |
|---|---|---|---|---|---|
| 5,419,714 | A * | 5/1995 | Nagamine | 439/364 |
| 5,425,657 | A * | 6/1995 | Davis et al. | 439/607.52 |
| 5,557,210 | A * | 9/1996 | Cappa et al. | 324/539 |
| 5,567,181 | A * | 10/1996 | Lentz et al. | 439/694 |
| 5,713,757 | A * | 2/1998 | Karst et al. | 439/445 |
| 5,921,801 | A | 7/1999 | O'Sullivan et al. | |
| 6,095,845 | A * | 8/2000 | Murphy | 439/364 |
| 6,139,354 | A * | 10/2000 | Broussard | 439/447 |
| 6,139,359 | A | 10/2000 | Fuhreck et al. | |
| 6,273,742 | B1 * | 8/2001 | Castagna et al. | 439/362 |
| 6,517,377 | B2 * | 2/2003 | Vaden | 439/502 |
| 6,582,244 | B2 * | 6/2003 | Fogg et al. | 439/362 |
| 6,804,113 | B2 * | 10/2004 | Kambayashi et al. | 361/679.45 |
| 6,916,210 | B2 * | 7/2005 | Moore et al. | 439/685 |
| 7,074,076 | B2 * | 7/2006 | Richter | 439/499 |
| 7,101,223 | B2 * | 9/2006 | Neumann et al. | 439/585 |
| 7,163,412 | B2 * | 1/2007 | Fan et al. | 439/258 |
| 7,494,374 | B2 * | 2/2009 | Hall et al. | 439/564 |
| 7,578,699 | B2 * | 8/2009 | Yin | 439/553 |
| 7,632,124 | B2 | 12/2009 | Kennedy et al. | |
| 7,892,025 | B2 * | 2/2011 | Daily et al. | 439/606 |
| 7,901,244 | B2 | 3/2011 | Lee et al. | |
| 8,231,399 | B2 * | 7/2012 | Daubigney | 439/316 |

* cited by examiner

SCREW DOWN CONNECTOR

BACKGROUND

1. Technical Field

The invention relates to a screw down connector.

2. Description of the Related Art

Various connectors are utilized to couple electronic components, power sources, communications equipment and portable devices. Different connectors are designed to accommodate multiple conductors, avoid accidental disconnection from vibration or other forces, or achieve a degree of moisture resistance or waterproofing.

Connectors for computer peripherals such as monitors and printers include multiple conductors to carry low voltage signals. The connectors have a straight-line configuration with the cable extending out the back of the connector, in-line with the conductors and the plug and un-plug direction. For example, U.S. Pat. No. 5,921,801 provides a retention system where the thumb screws are adjacent the rear of the connector housing and threaded members are separate from the device housing. U.S. Pat. No. 7,901,244 discloses a stacked connector which provides an analog and digital video jack on the back of a personal computer with removable fastening posts 128, 148. Neither of these computer connectors addresses moisture resistance or waterproofing.

U.S. Pat. No. 7,632,124 discloses a connector having individual O-ring seals 25 on each male conductor pin 27. The connector is secured with screw fasteners 30 that extend through the contact carrier and are disposed adjacent the connector housing. U.S. Pat. No. 6,139,359 discloses a connector incorporated into a battery pack for portable tools having two conductors. The connector includes an O-ring 87 and a friction clip to secure the battery to the tool. The connector lacks a locking mechanism, and rather is designed to uncouple upon application of sufficient pull force in order to swap a fully charged battery into the tool.

Advanced power systems and portable batteries have multiple high voltage contacts that are present in their power couplings or connectors. In certain applications, such as military applications, the portable battery utilizes a standard connector and is deployed in the field. These two factors limit the ability of engineers to modify the configuration of the standard connector. Due to the rugged service conditions of these battery connectors there is a need for the connectors to have a locking feature that resists unintentional disconnection. In addition, certain environmental conditions require that these connectors be waterproof. Prior art solutions have provided a large rubber boot that fits over the entire top surface of the unit. This solution has several drawbacks. When the top surface is covered, the user does not have access to the controls and indicators located thereon. In addition, the boot only adds a small incremental advantage in pull tests.

Accordingly, it would be desirable to provide a multi-conductor connector that retrofits to existing portable batteries and provides a waterproof seal with high pull test scores.

SUMMARY OF THE INVENTION

It is therefore an object of the invention to provide a multi-conductor connector that retrofits to existing power systems and portable batteries.

It is another object to provide a connector with a waterproof seal.

It is a further object to provide a connector with an easily operated screw down lock.

It is another object to provide a connector with a right angle housing so that the thumb screws are readily accessible.

These and other objects are achieved according to an embodiment of the invention including an apparatus for securely connecting a plug having contacts. The apparatus has a plug housing enclosing a contact carrier and including outwardly extending flanges having screw-receiving bores. A plug screw extends through each bore, wherein each screw includes a male thread on a proximal end that is adapted to engage a female thread on an upper portion of a socket retaining member that retains a socket on an electrical device by attaching to a stationary insert that is disposed within an electrical device housing.

Male contact pins are supported by the contact carrier, which is a circular disk. The portion of the housing which encloses the contact carrier is a cylindrical tube. Two flanges are disposed in diametrically opposed locations about the cylindrical tube. The flanges and housing are integrally-molded as a single piece. The plug includes a multi-conductor cable, and the housing includes a strain relief integrally-molded around the cable. The strain relief is integrally-molded around the cable and extends laterally outwardly from the plug at a right angle.

Each of the plug screws has a distal end remote from the proximal end and a central section disposed between the distal and proximal ends. The central section is sized to allow axial movement within the screw-receiving bores. A clip snaps onto a neck located between the central section and the proximal end to retain the central section of the screw within the screw-receiving bore. The distal end has a diameter larger than the screw-receiving bore and a length extending beyond the housing to provide manual access to the distal end which comprises a thumb screw.

Male contact pins are supported by the contact carrier which is a circular disk. The housing includes a cylindrical tube section that encloses the contact carrier. The screw-receiving bores and the central section of said plug screws are located radially outwardly of the contact carrier. A sealing O-ring is disposed about the periphery of the contact carrier. The plug housing includes a cylindrical tube that extends beyond the contact carrier to form a skirt disposed radially outwardly of the contacts which comprise male contact pins. The skirt is adapted to surround the socket of the electrical device.

A male thread on the proximal end of the plug screw is disposed radially outwardly of the male contact pins and the skirt. Tightening of the plug screws places an axial force on the flanges, ring and contact carrier which compresses the O-ring. The axial force on the contact carrier compresses the O-ring which is adapted to form a water-tight seal against the socket. The plug screws are adapted to unscrew from the socket retaining member with a lesser force than required to unscrew the socket retaining member from the stationary insert.

As a retrofit kit, the kit includes socket retaining members to replace machine screws. Plugs equipped with an O-ring, flanges and plug screws are provided to attach to the socket retaining members. The screw down plug compresses the O-ring to form a water-tight seal. The kit is installed by removing machine screws 12 from the socket and installing socket retaining members with a high torque T to secure the socket to the battery. A new plug is plugged into the socket and screwed-down by hand-tightening plug screws to a low torque t. Rotating the plug screws compresses newly provided O-ring to form a waterproof seal between the plug and socket. The plug screws can be removed and installed with torque t many times without effecting socket retaining members that are installed with torque T that is greater than t.

BRIEF DESCRIPTION OF DRAWINGS

The advantages, nature, and various additional features of the invention will appear more fully upon consideration of the illustrative embodiments now to be described in detail in connection with accompanying drawings. In the drawings wherein like reference numerals denote similar components throughout the views.

DETAILED DESCRIPTION OF PREFERRED EMBODIMENTS

These and other objects, features and advantages of the present invention will become apparent from the following detailed description of illustrative embodiments thereof, which is to be read in connection with the accompanying drawings.

Figure 2:
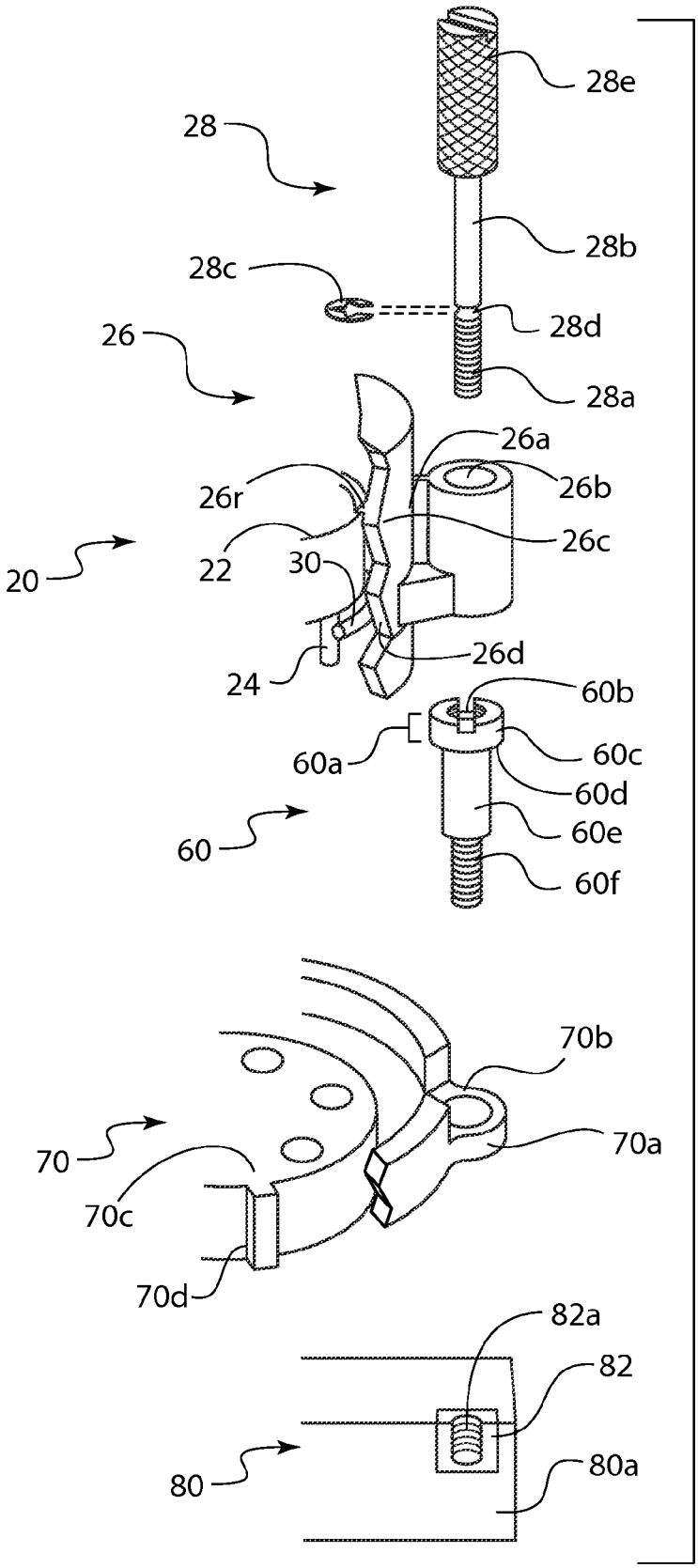
FIG. 2 is an exploded view of an embodiment of the screw down connector according to the invention.

The present invention provides an electrical connector that retrofits to existing power supplies and portable batteries with a screw down locking feature which provides excellent pull test results and a waterproof seal. In summary, one embodiment of the invention illustrated in FIG. 2 provides a plug 20 having a flange 26*a* on a right angle housing 26 to carry a plug screw 28. The existing machine screw is replaced by a socket retaining member 60, which is modified to include a female thread 60*b* in its top 60*a*. An O-ring 30 is disposed around the periphery of the contact carrier 22. The thumb screw 28*e* is easily accessible to screw down the plug 20 to avoid accidental disconnection and provide a waterproof connection.

Figure 1:
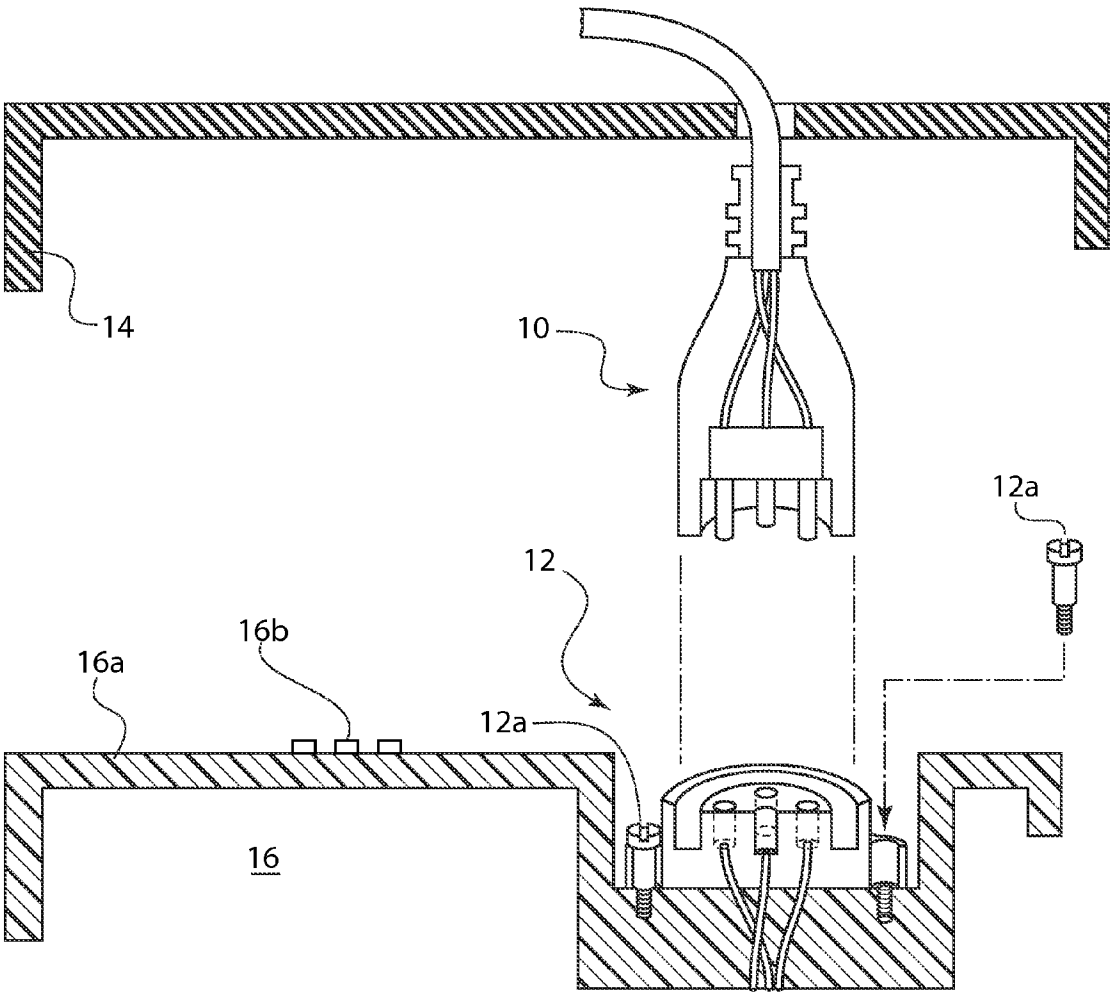
FIG. 1 (Prior Art)
FIG. 1 is a side schematic view of the prior art connector and boot cover.

According to the prior art configuration as shown in FIG. 1, male connector 10 was devoid of outwardly extending flanges and the corresponding plug screws. In addition the socket 12 did not have a mechanism that would allow connector 10 to latch or lock on to. Socket 12 was secured to the device 16 by conventional machine screws 12*a*. Plug 10 was retained in socket 12 by a friction fit, which made the coupling susceptible to accidental disconnection. To provide a degree of moisture resistance, a large boot 14 was used to cover the entire top surface 16*a* of the portable battery 16. While in place, boot 14 restricts access to controls and indicators, generally illustrated by reference numeral 16*b*.

Accordingly, there is a need to provide a more robust connection that is waterproof and allows access the top surface of battery 16. Many batteries 16 with installed sockets 12 have already been manufactured. As a result the configuration of socket 12 cannot be changed. The challenge to engineers is to improve the connection between plug and socket where only the plug can be modified. The batteries and their original sockets cannot be redesigned or replaced since they are relatively expensive pieces of equipment, and many batteries are already out in the field in continuous use.

As can be seen in FIG. 2, one embodiment of the invention includes a flange-equipped plug, a plug screw and a socket retaining member which are designed to retrofit onto an existing battery 80 and socket 70. Compared to the prior art plug 10 shown in FIG. 1, the plug 20 according to the invention of FIG. 2 includes a screw down, variable compression seal. The electrical components of plug 20 include a contact carrier 22 that supports contacts 24 in the form of male pins. Contact carrier is a circular disk, having extended therethrough, for example, six male contact pins to carry several high voltage circuits. In addition, small pogo or stationary pins may be included to carry low voltage signals to and from the battery in the case of a smart battery. The contact carrier 22 brings contacts 24 into mating connection with the female contact slots on socket 70. An O-ring 30 is disposed around the periphery of contact carrier 22 to provide a waterproof seal to the periphery of socket face 70*c*. When O-ring 30 is subject to sufficient compression between contact carrier 22 and socket face 70*c* external moisture and liquid is effectively prevented from seeping into the electrical contacts.

The plug housing 26 is designed with a low profile height and a generally cylindrical tube 26*c* surrounding contact carrier 22. A section of the housing extends below the tube and is formed as a skirt 26*d*. O-ring 30 is set within the corner where contact carrier 22 meets skirt 26*d*. Skirt 26*d* keeps the O-ring from expanding beyond the edge of face 70*c*. The interior of skirt 26*d* may be provided with slots or keyways at locations that correspond to ridges or keys 70*d* on the exterior, cylindrical surface of socket 70. The keys and keyways are set at irregular intervals so that the plug can only couple to the socket in one configuration. This insures that the different functions of the contacts are properly assigned to the mating connector when a coupling is made.

Flanges 26*a* extend laterally off the side of the housing 26. More particularly, two flanges are disposed in diametrically opposed locations outside of cylindrical tube 26*c*. Flanges 26*a* are positioned radially outwardly of contact carrier 22. The plug housing 26 and flanges 26*a* are integrally-molded as a single piece. For example, the plug housing may be manufactured by placing the contact carrier, contacts and cable into a mold and then overmolding the plug, flanges and strain relief in one molding cycle. Radially inwardly of the flanges, a ring 26*r* is formed that sits on top of the edge of contact carrier 22. Ring 26*r* is axially positioned above O-ring 30. As the plug screws are tightened on opposite sides, ring 26*r* exerts a downward force on contact carrier 22. The circular shape of the ring and contact carrier provides even pressure along the entire length of the O-ring. This insures that O-ring forms an even seal between the inner corner where the contact carrier 22 meets the skirt 26*d* and the outer corner where deck 70*c* meets exterior cylindrical surface (where keys 70*d* reside).

Flanges 26*a* include screw-receiving bores 26*b*. A plug screw 28 is fitted into each bore. From the bottom up plug screw 28 includes a proximal male thread 28*a*, a central section 28*b*, and a distal end 28*e*. The proximal end is inserted through the bore with central section 28*b* residing within the bore. Central section 28*b* is longer than the bore so as allow some axial movement of plug screw 28 within the bore. Bore 26*b* is of sufficient length to maintain plug screw 28 in alignment with its mating female thread. Between central section 28*b* and proximal end 28*a* is a narrow neck 28*d*. A clip 28*c* attached to neck 28*d* after the screw is inserted through the bore. Clip 28*c* prevents the screw from being removed from the bore. At the other end, the diameter of the distal end 28*e* is larger than the bore. Accordingly, the bore effectively captures the central section 28*b* of the plug screw 28, and supports it for limited axial travel during threading.

In the prior art connector of FIG. 1, socket 12 was configured to only retain the plug 10 by frictional engagement. Socket 12 was bolted to electrical device, e.g. battery 16 by a machine screw 12*a*. The battery is equipped with a well that is formed by a depression in the top surface of electrical device housing. Socket 12 sat in the well and machine screws 12*a* passed through ears and threaded into the female threads of inserts.

FIG. 2 shows that screws 12*a* have been replaced with a socket retaining member 60 having a head 60*c* with a downwardly facing shoulder 60*d* that sits on deck 70*b* of socket ear 70*a*. When installed, the middle portion 60*e* resides within ear 70*a*, while the male threads of lower portion 60*f* engage female threads 82*a* of insert 82. When socket retaining member 60 is tightened, shoulder 60*d* presses down on deck 70*b* to secure socket 70 to electrical device 80. Socket retaining member was previously a slotted head machine screw.

Socket retaining member 60 is provided with a female thread 60*b* formed in its upper portion 60*a*. The female threads were dimensioned with a diameter smaller than middle portion 60*e* and a length that allows plug screw 28 to thread in about 4 to 15 turns. The length of the female threads may extend between 40% and 90% of the combined height of head 60*c* and middle portion 60*e*. Flanges 26*a* are laterally dimensioned to position bore 26*b* axially above, and centrally aligned with, socket retaining member 60. Bore 26*b* and plug screw 28 are axially dimensioned so that plug 20 can be installed onto socket 70 without interference. Once plug 20 is fully seated, screws 28 will loosely rest on socket retaining member 60. Screw 28 has a thread pitch that is configured to bring distal end 28*e* down to flange 26*a* after several initial turns. Thereafter, continued turning of screw 28 will provide a downward force on flange 26*a* and the entire plug housing 26 toward socket 70. This downward force compresses O-ring 30 between contact carrier 22 and socket face 70*c*.

Figure 3:
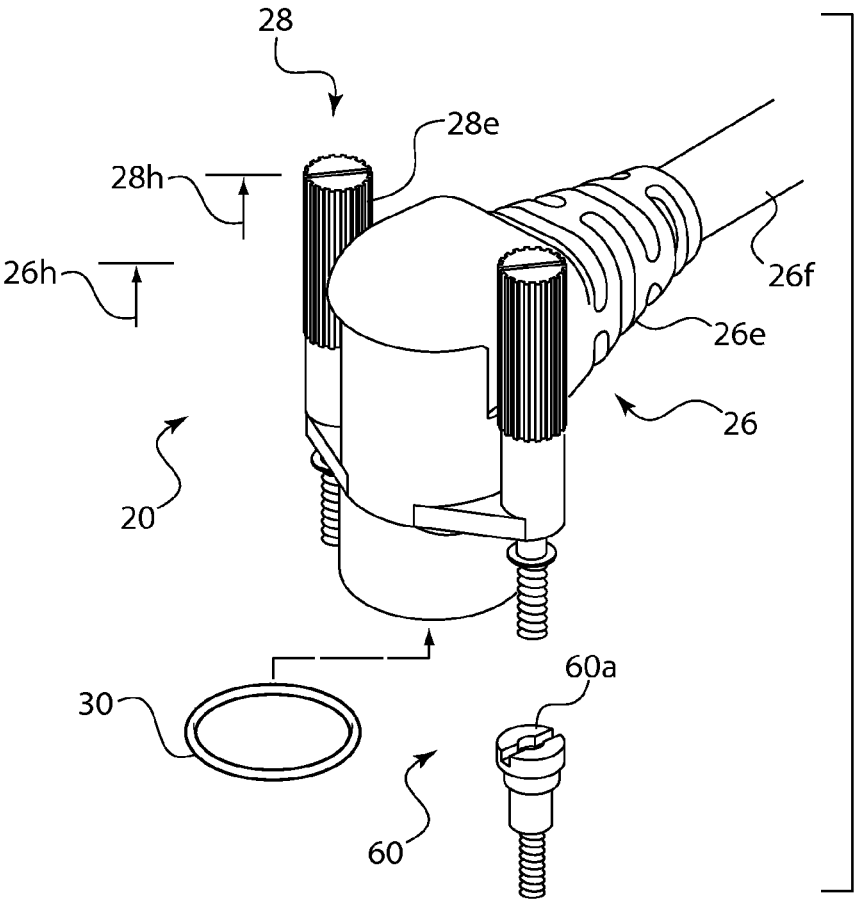
FIG. 3 is a perspective view of the screw down connector housing and modified socket retaining member.

A perspective view of plug 20 may be seen in FIG. 3 where housing 26 is a right angle connector having an integrally molded strain relief 26*e* for cable 26*f*. The right angle turn at the top of housing 26 provides a low-profile height 26*h*. The distal end 28*e* of plug screw 28 has a greater height 28*h* so that the knurled, thumb screw portion of plug screw can be readily accessed for manual turning. According to another embodiment, the invention includes the components shown in FIG. 3 which comprise a retrofit kit. The kit includes the right angle housing 26 equipped with plug screws 28 and O-ring 30 along with socket retaining members 60. Socket retaining member 60 includes a slot formed in its upper portion 60*a*. To install the screw down waterproof plug kit, the old machine screw 12*a* is removed. Socket retaining member 60 is installed to secure socket 70 to the electrical device housing 80*a*. Plug 20 and socket 60 have complementary slots and keys so that the plug can only be inserted into socket 60 in one orientation. Plug housing 26 is configured so that the flanges 26*a* and plug screws 28 will align over the socket retaining members in that one orientation.

Figure 4:
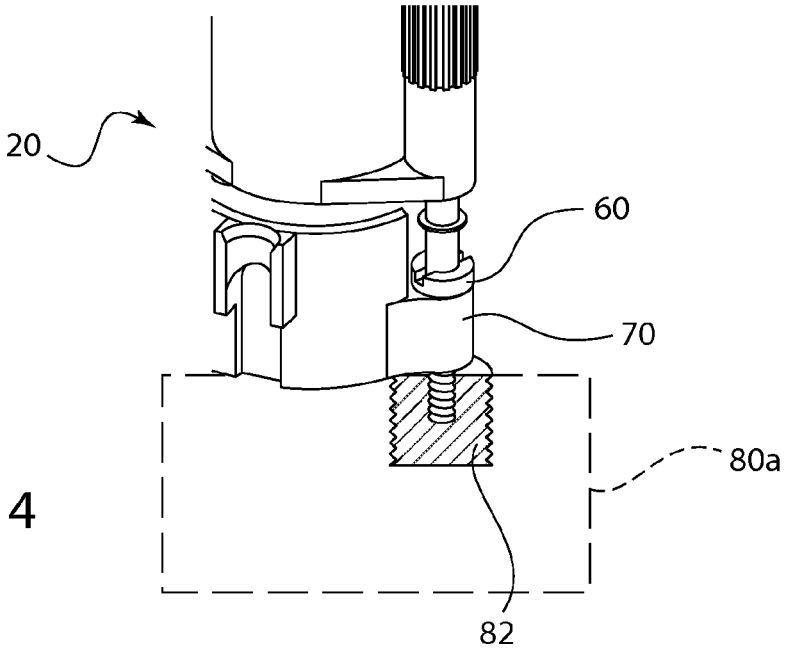
FIG. 4 is a perspective view of the connector screwed down into the socket retaining member to form a waterproof seal.

As can be seen in FIG. 4 the old machine screw 12 has been replaced with socket retaining member 60 to secure socket 70 to battery housing 80*a*. This screw replacement can be carried out in the field with a screw driver, pocket knife, coin, etc. Ideally a screwdriver is used to tightly secure socket retaining member 60 to insert 82. Insert 82 has a textured or knurled outer surface that allows insert to be held securely in place when electrical device housing is molded to it. Accordingly socket retaining member 60 can be tightened with a high degree of torque. As a result the torque required to unscrew socket retaining member will require mechanical means and will be a high value T. In contrast, plug screws 28 are designed to be hand tightened by gripping the thumb screw portion 28*e*. The torque required to unscrew plug screw can be achieved by manual operation and will be a low value t. Use of the invention preferentially uses mechanical means to tighten socket retaining member 60 and manual means to tighten plug screw 28. In this manner the torque t needed to unscrew plug screw 28 will be significantly less than the torque T required to unscrew socket retaining member 60. Accordingly, plug screw 28 can be attached and removed many times without causing socket retaining member 60 to loosen.

The completed assembly provides a plug housing with screw down capability to retrofit to existing sockets. The plug screws gradually compress the O-ring to form a waterproof seal. The screw down feature improves the pull test performance to avoid accidental or vibration-induced disconnection between the plug and socket.

Having described preferred embodiments for (which are intended to be illustrative and not limiting), it is noted that modifications and variations can be made by persons skilled in the art in light of the above teachings. The flanges may be of alternate shape or height while still locating the plug screws above the socket retaining members. The plug housing may be formed from a wide array of materials and by various manufacturing methods. The plug screws may be different diameters and lengths while still effectively providing a screw down feature to seal the connection and offer positive pull test results. It is therefore to be understood that changes may be made in the particular embodiments of the invention disclosed which are within the scope and spirit of the invention as outlined by the appended claims. Having thus described the invention with the details and particularity required by the patent laws, what is claimed and desired protected by Letters Patent is set forth in the appended claims.

What is claimed is:

1. An apparatus for securely connecting a plug having contacts comprising:

a plug housing enclosing a multi-conductor cable and a circular disk contact carrier supporting male contact pins and including a cylindrical tube that extends beyond said contact carrier to form a skirt disposed radially outwardly of the contacts and a strain relief integrally-molded around the cable which extends laterally outwardly from the plug at a right angle and outwardly extending flanges having screw-receiving bores;

a sealing O-ring disposed about the periphery of said contact carrier; and a plug screw extending through each bore, wherein each screw includes a proximal end and a distal end remote from said proximal end and a central section disposed between said distal and proximal ends, wherein said central section is sized to allow axial movement within the screw-receiving bore and a male thread on the proximal end that is adapted to engage a female thread on an upper portion of a socket retaining member that retains a socket on an electrical device by attaching to a stationary insert that is disposed within an electrical device housing.

2. The apparatus of claim 1, wherein two flanges are disposed in diametrically opposed locations about the cylindrical tube.

3. The apparatus of claim 2, wherein said flanges and housing are integrally-molded as a single piece.

4. The apparatus of claim 3, wherein said housing includes a strain relief integrally-molded around the cable.

5. The apparatus of claim 1, further including a clip that snaps onto a neck located between the central section and the proximal end to retain the central section of the screw within the screw-receiving bore.

6. The apparatus of claim 1, wherein the distal end has a diameter larger than the screw-receiving bore and a length extending beyond the housing to provide manual access to the distal end which comprises a thumb screw.

7. The apparatus of claim 1, wherein said skirt is adapted to surround the socket of the electrical device.

8. The apparatus of claim 7, wherein said male thread on said proximal end of said plug screw is disposed radially outwardly of said male contact pins and said skirt.

9. The apparatus of claim 8, wherein tightening of said plug screws places an axial force on said flanges and contact carrier which compresses said O-ring.

10. The apparatus of claim 9, wherein the axial force on said contact carrier compresses said O-ring which is adapted to form a water-tight seal against the socket.

11. The apparatus of claim 10, wherein said plug screws are adapted to unscrew from the socket retaining member with a lesser force than required to unscrew the socket retaining member from the stationary insert.

12. An apparatus for securely connecting a plug having contacts comprising:

a plug housing enclosing a contact carrier which supports male contact pins and including outwardly extending flanges having screw-receiving bores and a cylindrical tube that extends beyond said contact carrier to form a skirt disposed radially outwardly of the male contact pins; and a plug screw extending through each bore, wherein each screw includes a male thread on a proximal end that is adapted to engage a female thread on an upper portion of a socket retaining member that retains a socket on an electrical device by attaching to a stationary insert that is disposed within an electrical device housing.

13. The apparatus of claim 12, wherein said housing, said flanges and said skirt are integrally-molded as a single piece.

14. The apparatus of claim 12, further including a sealing O-ring disposed in contact with the periphery of said contact carrier which comprises a circular disk.

15. The apparatus of claim 14, wherein said O-ring is set within the corner where said contact carrier meets said skirt.

16. The apparatus of claim 14, wherein tightening of said plug screws places an axial force on said flanges and contact carrier which compresses said O-ring.

17. The apparatus of claim 16, wherein the axial force on said contact carrier compresses said O-ring which is adapted to form a water-tight seal between said contact carrier and the socket.

18. The apparatus of claim 12, wherein said plug screws are adapted to unscrew from the socket retaining member with a lesser force than required to unscrew the socket retaining member from the stationary insert.

* * * * *